US010090144B2

(12) United States Patent
Brown

(10) Patent No.: US 10,090,144 B2
(45) Date of Patent: Oct. 2, 2018

(54) LIQUID EXTRACTION MATRIX ASSISTED LASER DESORPTION IONISATION ION SOURCE

(71) Applicant: Micromass UK Limited, Wilmslow (GB)

(72) Inventor: Jeffery Mark Brown, Hyde (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/126,721

(22) PCT Filed: Mar. 18, 2015

(86) PCT No.: PCT/GB2015/000095
§ 371 (c)(1),
(2) Date: Sep. 16, 2016

(87) PCT Pub. No.: WO2015/140491
PCT Pub. Date: Sep. 24, 2015

(65) Prior Publication Data

US 2017/0117125 A1 Apr. 27, 2017

(30) Foreign Application Priority Data

Mar. 18, 2014 (EP) ..... 14160588
Mar. 18, 2014 (GB) ..... 1404847.4

(51) Int. Cl.
*H01J 49/00* (2006.01)
*H01J 49/16* (2006.01)
*H01J 49/04* (2006.01)

(52) U.S. Cl.
CPC ..... *H01J 49/164* (2013.01); *H01J 49/0431* (2013.01); *H01J 49/165* (2013.01)

(58) Field of Classification Search
CPC ..... H01J 49/164; H01J 49/165; H01J 49/0431
(Continued)

(56) References Cited

U.S. PATENT DOCUMENTS 5,965,884 A 10/1999 Laiko et al.
6,140,639 A 10/2000 Gusev et al.
(Continued)

FOREIGN PATENT DOCUMENTS

GB 2511643 10/2014
WO 98/53308 11/1998

OTHER PUBLICATIONS

Sampson et al., "Generation and Detection of Multiply-Charged Peptides and Proteins by Matrix-Assisted Laser Desorption Electrospray Ionization (MALDESI) Fourier Transform Ion Cyclotron Resonance Mass Spectrometry", Journal American Society for Mass Spectrometry , vol. 17, No. 12, pp. 1712-1716, 2006.
(Continued)

*Primary Examiner* — Nicole Ippolito
*Assistant Examiner* — Hanway Chang
(74) *Attorney, Agent, or Firm* — Womble Bond Dickinson (US) LLP; Deborah M. Vernon; Heath T. Misley

(57) ABSTRACT

A Matrix Assisted Laser Desorption Ionization ("MALDI") ion source is disclosed comprising a first device arranged and adapted to supply a flow of liquid on to the surface of a target or a sample to be analyzed so that the liquid forms a liquid junction on the surface of the target or the sample to be analyzed and wherein analyte molecules to be ionized are extracted into the liquid junction, and a laser source emits a laser beam which causes analyte ions or an analyte plume to be released or desorbed from the liquid junction.

20 Claims, 1 Drawing Sheet

(58) Field of Classification Search
USPC ..... 250/281, 282, 288
See application file for complete search history.

(56) References Cited

U.S. PATENT DOCUMENTS

| | | | | |
|---|---|---|---|---|
| 6,674,070 | B2 | 1/2004 | Karger et al. | |
| 7,087,898 | B2 | 8/2006 | Willoughby et al. | |
| 7,193,233 | B2 | 3/2007 | Franzen | |
| 8,202,494 | B2 | 6/2012 | Li et al. | |
| 8,299,444 | B2 | 10/2012 | Ding et al. | |
| 8,710,436 | B2 | 4/2014 | Otsuka | |
| 9,146,180 | B2 | 9/2015 | Van Berkel et al. | |
| 2013/0214154 | A1 | 8/2013 | McEwen et al. | |
| 2014/0070088 | A1* | 3/2014 | Otsuka ..... | G01N 1/22 250/282 |
| 2016/0020079 | A1 | 1/2016 | Brown | |

OTHER PUBLICATIONS

Roach et al., "Nanospray desorption electrospray ionization: all ambient method for liquid-extraction surface sampling in mass spectrometry", Analyst, Issue 9, pp. 2233-2236.

* cited by examiner

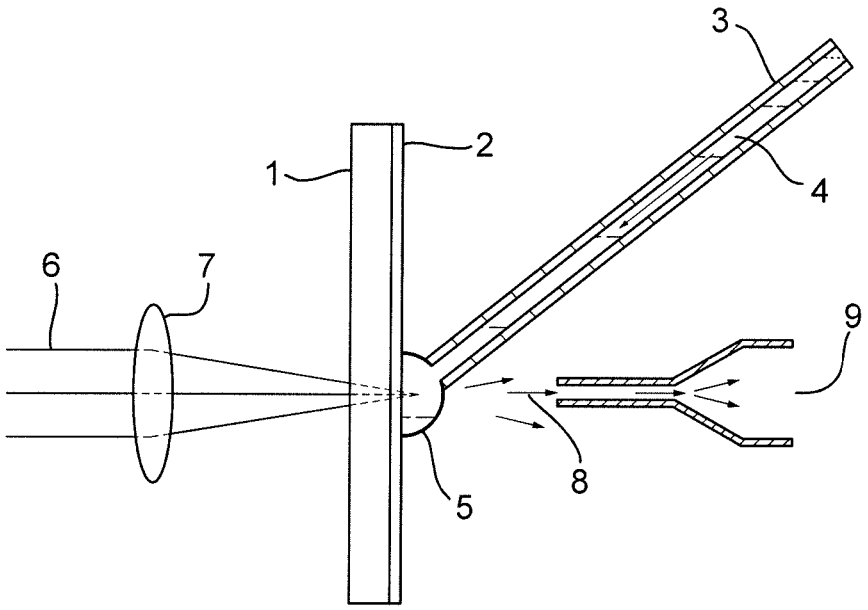
3
2
1
4
6
7
9
8
5

LIQUID EXTRACTION MATRIX ASSISTED LASER DESORPTION IONISATION ION SOURCE

CROSS REFERENCE TO RELATED APPLICATION APPLICATIONS

This application is the National Stage of International Application No. PCT/GB2015/000095, filed 18 Mar. 2015 which claims priority from and the benefit of United Kingdom patent application No. 1404847.4 filed on 18 Mar. 2014 and European patent application No. 14160588.1 filed on 18 Mar. 2014. The entire contents of these applications are incorporated herein by reference.

FIELD OF THE INVENTION

The present invention relates generally to mass spectrometry and in particular to Matrix Assisted Laser Desorption Ionisation ("MALDI") ion sources, mass spectrometers, methods of ionising ions and methods of mass spectrometry.

BACKGROUND

Liquid extraction surface analysis ("LESA") is a known technique whereby samples are extracted from a surface into a small liquid junction for further analysis by an Electrospray ionisation ("ESI") ion source. Liquid extraction surface analysis has been used for imaging of tissue sections at fairly modest spatial resolution.

According to a known arrangement a crystallised Matrix Assisted Laser Desorption Ionisation matrix is provided and desorbed ions or particles are ionised or further ionised by an Electrospray ionisation ion source.

US2014/0070088 (Otsuka) discloses an Electrospray ionisation device.

It is desired to provide an improved ion source and an improved method of ionising a sample.

SUMMARY

According to an aspect there is provided a Matrix Assisted Laser Desorption Ionisation ("MALDI") ion source comprising:

a first device arranged and adapted to supply a flow of liquid on to the surface of a target or a sample to be analysed so that the liquid forms a liquid junction on the surface of the target or the sample to be analysed and wherein analyte molecules to be ionised are extracted into the liquid junction; and.

a laser source arranged and adapted to emit a laser beam, wherein the laser beam is arranged and adapted to cause analyte ions or an analyte plume to be released or desorbed from the liquid junction.

An embodiment relates to liquid extraction Matrix Assisted Laser Desorption Ionisation ("LE-MALDI") and liquid extraction Laser Desorption Ionisation.

According to an embodiment a flow of liquid may be provided onto a sample surface and provides a liquid junction between e.g. a capillary and the sample surface. The liquid, which may be supplied on to the surface of the sample, may extract at least some of the sample or analytes into the liquid junction. The sample or analytes are subsequently exposed to and may be ionised by a laser which causes analyte ions and/or an analyte plume to be released and/or desorbed from the liquid junction. The resulting analyte ions and/or ions obtained by ionising or further ionising the analyte plume are then mass analysed by a mass spectrometer.

Ions may be generated by a Matrix Assisted Laser Desorption Ionisation ion source or a Laser Desorption ("LD") ion source directly from a liquid junction. The resulting ions are subjected to analysis in a mass spectrometer or other analytical instrument.

This is in contrast with the arrangement disclosed in US 2014/0070088 (Otsuka) wherein an ionisation device is provided in which a liquid bridge is subjected to Electrospray Ionisation ("ESI") by applying a voltage to an electrode. A laser beam is applied to the solvent bridge to improve the dissolving of analyte in the solvent, prior to conventional electrospray ionisation. US 2014/0070088 (Otsuka) discloses an Electrospray Ionisation ("ESI") ion source and does not disclose a Matrix Assisted Laser Desorption Ionisation ("MALDI") ion source.

The laser disclosed in US 2014/0070088 (Otsuka) does not cause analyte ions or an analyte plume to be released or desorbed from the liquid bridge.

An embodiment comprises a Matrix Assisted Laser Desorption Ionisation technique and is particularly advantageous in that the method of ionisation is a particularly sensitive ionisation technique which is advantageously more tolerant to salts and ionisation suppression effects than Electrospray Ionisation ("ESI").

A further advantage of the Matrix Assisted Laser Desorption Ionisation ion source is that in enables useful complementary information to be provided in addition to information obtained using an Electrospray Ionisation ("ESI") ion source.

An embodiment enables extra time for data directed processing control systems to target fast eluting data.

According to an embodiment, the sample to be analysed is mounted or otherwise provided on the target.

According to an embodiment, the target is at least partially formed from the sample to be analysed.

According to an embodiment, the liquid is arranged to be supplied on to the surface of the target and/or the surface of the sample to be analysed.

According to an embodiment, the flow of the liquid comprises a substantially continuous flow of the liquid.

According to an embodiment, the liquid comprises one or more extraction solvents and/or one or more Matrix Assisted Laser Desorption Ionisation matrix substances.

According to an embodiment, the one or more extraction solvents and/or the one or more Matrix Assisted Laser Desorption Ionisation matrix substances are arranged to draw out or extract one or more analytes from the target and/or the sample to be analysed.

According to an embodiment, the laser beam is arranged and adapted to ionise the analyte molecules in the liquid junction.

According to an embodiment, the Matrix Assisted Laser Desorption Ionisation ion source comprises a focusing device for focusing the laser beam to a focal point.

According to an embodiment, the focal point is arranged so as to be located either upstream of the target, within the target, upon an upper surface of the target or sample to be analysed, at a location immediately adjacent an upper surface of the target or sample to be analysed or at a location downstream of an upper surface of the target or sample to be analysed.

According to an embodiment, the laser beam may be arranged to impinge upon a rear surface of the target and to pass through the target so as to ionise analyte present in a liquid junction located on an upper surface of the target or the sample to be analysed.

According to an embodiment, the laser beam may be arranged to impinge upon an upper surface of the target or the sample to be analysed, optionally without substantially being transmitted through the target, so as to ionise analyte present in a liquid junction located on an upper surface of the target or the sample to be analysed.

According to an aspect there is provided a mass spectrometer comprising a Matrix Assisted Laser Desorption Ionisation ion source as described above.

According to an embodiment, the mass spectrometer may comprise an Electrospray Ionisation ion source.

According to an embodiment, the Electrospray Ionisation ion source may be arranged and adapted to ionise or further ionise the analyte plume released from the liquid junction.

According to an aspect there is provided a method of ionising a sample comprising:

providing a Matrix Assisted Laser Desorption Ionisation ion source;

supplying a flow of liquid on to the surface of a target or a sample to be analysed so that the liquid forms a liquid junction on the surface of the target or the sample to be analysed and so that analyte molecules to be ionised are extracted into the liquid junction; and using a laser beam to cause analyte ions or an analyte plume to be released or desorbed from the liquid junction.

According to an aspect there is provided a method of mass spectrometry comprising a method as described above.

According to an aspect there is provided a Matrix Assisted Laser Desorption Ionisation ("MALDI") ion source comprising:

a first device arranged and adapted to supply a flow of liquid on to the surface of a target or a sample to be analysed.

The sample to be analysed may be mounted or otherwise provided on the target.

According to another embodiment the target may at least partially be formed from the sample to be analysed.

According to an embodiment the liquid may be arranged to be supplied on to the surface of the target and/or the surface of the sample to be analysed.

The first device may supply, in use, the liquid so that the liquid forms a liquid junction on the surface of the target and/or the sample to be analysed and wherein analyte molecules to be ionised are extracted into the liquid junction.

The liquid may comprise one or more extraction solvents and/or one or more Matrix Assisted Laser Desorption Ionisation matrix substances.

The one or more extraction solvents and/or the one or more Matrix Assisted Laser Desorption Ionisation matrix substances may be arranged to draw out or extract one or more analytes from the target and/or the sample to be analysed.

The ion source may further comprise a laser source arranged and adapted to emit a laser beam.

The ion source may further comprise a focusing device for focusing the laser beam to a focal point.

The focal point may be arranged so as to be located either upstream of the target, within the target, upon an upper surface of the target or sample to be analysed, at a location immediately adjacent an upper surface of the target or sample to be analysed or at a location downstream of an upper surface of the target or sample to be analysed.

The laser beam may be arranged to impinge upon a rear surface of the target and to pass through the target so as to ionise analyte present in a liquid junction located on an upper surface of the target or the sample to be analysed.

The laser beam may be arranged to impinge upon an upper surface of the target or the sample to be analysed, may without substantially being transmitted through the target, so as to ionise analyte present in a liquid junction located on the upper surface of the target or the sample to be analysed.

According to another aspect there is provided a mass spectrometer comprising a Matrix Assisted Laser Desorption Ionisation ion source as described above.

The mass spectrometer may further comprise an Electrospray Ionisation ion source.

The Electrospray Ionisation ion source may be arranged and adapted to ionise or further ionise an analyte plume released from the liquid junction.

According to another aspect there is provided a method of ionising a sample comprising:

providing a Matrix Assisted Laser Desorption Ionisation ion source; and supplying a flow of liquid on to the surface of a target or a sample to be analysed.

According to another aspect there is provided a method of mass spectrometry comprising a method as described above.

According to another aspect there is provided an interface for an ion source comprising:

a first device arranged and adapted to supply a flow of liquid on to the surface of a target or sample to be analysed wherein the liquid is arranged to extract analyte molecules from the target or sample to be analysed so that a liquid junction comprising analyte molecules is formed on the surface of the target or sample to be analysed; and a second device arranged and adapted to desorb or release an analyte plume from the liquid junction, wherein the second device comprises a laser desorption device, an acoustic desorption device or a thermal desorption device.

According to another aspect there is provided an ion source comprising an interface as described above.

The ion source may comprise a corona discharge ion source, a glow discharge ion source, a surface collision ion source or an Electrospray Ionisation ion source and wherein the ion source may be arranged and adapted to ionise or further ionise the analyte plume.

According to another aspect there is provided a method of generating an analyte plume comprising:

supplying a flow of liquid on to the surface of a target or sample to be analysed wherein the liquid extracts analyte molecules from the target or sample to be analysed so that a liquid junction comprising analyte molecules is formed on the surface of the target or sample to be analysed; and desorbing or releasing an analyte plume from the liquid junction using a laser desorption device, an acoustic desorption device or a thermal desorption device.

According to another aspect there is provided a method of ionising a sample comprising a method as described above.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer may further comprise a device arranged and adapted to supply an AC or RF voltage to the electrodes. The AC or RF voltage may has an amplitude selected from the group consisting of: (i)<50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage may have a frequency selected from the group consisting of: (i)<100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i)<0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) C60 vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation may comprise interacting analyte ions with reagent ions, wherein the reagent ions comprise dicyanobenzene, 4-nitrotoluene or azulene.

BRIEF DESCRIPTION OF THE DRAWINGS

Various embodiments will now be described, by way of example only, and with reference to the accompanying drawing in which:

FIG. 1 shows an embodiment wherein an extraction liquid is supplied on to the surface of a sample in order to extract analyte molecules from the sample into a liquid junction wherein the liquid junction is then ionised by a laser beam to form an analyte plume which is subsequently analysed by a mass spectrometer.

DETAILED DESCRIPTION

An embodiment will now be described with reference to FIG. 1.

FIG. 1 shows an embodiment wherein an ion source is provided comprising a sample 2 provided on a slide 1. The slide 1 may be transparent to laser radiation and laser radiation 6 from a laser (not shown) may be focused to a focal point which may be located immediately downstream of the sample 2.

The slide 1 may be mounted on an x-y translation stage so that the slide 1 and associated sample 2 can be translated in both an x-direction and an orthogonal y-direction in order to enable ion imaging experiments to be performed wherein different portions of a sample are analysed and a mass spectral profile of the surface composition of the sample can be established.

A capillary 3 or other flow device may be provided adjacent to the sample 2 and a liquid flow 4 of extraction solvent(s) and/or liquid Matrix Assisted Laser Desorption Ionisation matrix/matrices may be supplied via the capillary 3 or other flow device. Fluid or liquid may emerge from an exit of the capillary 3 or other flow device and may form a liquid junction 5 on at least a portion of the sample 2.

A laser (not shown) may be arranged to generate a laser beam 6 which may be focussed by a lens 7 or other optical device to a focal point which according to the embodiment is arranged slightly downstream of the sample 2 and may be located in or within the liquid junction 5 which may be formed on the surface of the sample 2. However, other embodiments are contemplated wherein the focal point may be located at a different position e.g. upstream of the slide 1, within the slide 1, within or on the sample 2 or further downstream of the liquid junction 5.

The extraction solvent(s) and/or liquid Matrix Assisted Laser Desorption Ionisation matrix/matrices which may be supplied via the capillary 3 or other flow device may cause analytes to be extracted from the sample 2 so that the liquid junction 5 may comprise analyte or analyte molecules which have been extracted from the sample 2.

The laser beam 6 may be onwardly transmitted by the slide 1 which may be transparent, substantially transparent or semi-transparent to the laser radiation. According to an embodiment the slide 1 may transmit laser radiation without unduly attenuating the intensity of the laser radiation. According to an embodiment the slide 1 may be arranged to transmit at least 50%, 60%, 70%, 80% or 90% of the laser radiation received on the rear surface of the slide 1.

The focusing of the laser beam 6 on to the liquid junction 5 may cause analyte ions 8 to be released or desorbed from the liquid junction 5 or an analyte plume to be released. The analyte ions 8 may then be directed towards an inlet device 9 of a mass spectrometer (not shown) or another ion source. According to an embodiment the inlet device 9 may comprise an inlet capillary or a nozzle-skimmer interface.

The atmospheric pressure Matrix Assisted Laser Desorption Ionisation ("AP-MALDI") ion source according to the embodiment is particularly advantageous compared to a conventional Matrix Assisted Laser Desorption Ionisation ion source (wherein a sample is provided in a vacuum chamber) since there is no requirement to put the sample inside a vacuum chamber.

As a result, the ion source according to the embodiment described herein is less complex and less expensive compared with a conventional Matrix Assisted Laser Desorption Ionisation ion source.

The atmospheric pressure ion source according to an embodiment also advantageously enables the analysis of samples to be performed which are potentially incompatible with vacuum conditions such as, for example, electrophoresis gels and polymer membranes which are prone to shrink when exposed to low pressures.

The liquid atmospheric pressure Matrix Assisted Laser Desorption Ionisation ion source according to the embodiment enables multiply charged ions from proteins and peptides to be generated thereby allowing the analysis of relatively high molecular weight samples using a mass spectrometer having an atmospheric pressure ion inlet and/or wherein an ion inlet device of an atmospheric pressure mass spectrometer has an effective limitation on the mass to charge ratio transmission range of ions which may be transferred via the ion inlet device.

Another embodiment relates to the use of Matrix Assisted Laser Desorption Ionisation as the ionisation technique instead of and/or in addition to an Electrospray Ionisation ion source wherein the Matrix Assisted Laser Desorption Ionisation ion source may be combined with liquid extraction surface analysis.

The liquid extraction surface analysis liquid junction may be provided with a flow of extraction solvent(s) and/or liquid Matrix Assisted Laser Desorption Ionisation matrix/matrices wherein the total liquid flow rate into the junction may be substantially balanced by the ablation rate caused by the Matrix Assisted Laser Desorption Ionisation laser or other ionisation source.

Although liquid extraction surface analysis has only modest imaging resolution compared with conventional Matrix Assisted Laser Desorption Ionisation techniques, according to an embodiment the ion source may be operated in various different modes of operation allowing a combination of techniques to be performed.

According to an embodiment multiply charged Atmospheric Pressure Matrix Assisted Laser Desorption Ionisation surface imaging may be performed with liquid extraction surface analysis providing the liquid Matrix Assisted Laser Desorption Ionisation matrices resulting in analyte extraction.

According to an alternative embodiment the laser beam may be arranged to impinge upon the target or sample to be analysed utilising a reflection geometry rather than a transmission geometry.

According to an embodiment a laser may be used that assists in the extraction of sample from the surface for enhancing liquid extraction surface analysis devices. However, other embodiments are contemplated wherein desorption by other methods such as acoustic desorption and thermal desorption may be utilised.

According to an embodiment the desorbed plume may not necessarily be immediately ionised or may only be partially ionised in which case the desorbed plume may then be ionised using a corona discharge ion source, a glow discharge ion source, a surface collision ion source or another type of ion source.

Although a preferred embodiment of the present invention has been described with reference to preferred embodiments, it will be understood by those skilled in the art that various changes in form and detail may be made without departing from the scope of the invention as set forth in the accompanying claims.

The invention claimed is:

1. A Matrix Assisted Laser Desorption Ionisation ("MALDI") ion source comprising:

a first device arranged and adapted to supply a flow of liquid on to the surface of a target or a sample to be analysed so that said liquid forms a liquid junction on the surface of said target or said sample to be analysed and wherein analyte molecules to be ionised are extracted into said liquid junction; and a laser source arranged and adapted to emit a laser beam, wherein said laser beam is arranged and adapted to cause analyte ions or an analyte plume to be released or desorbed from said liquid junction.

2. A Matrix Assisted Laser Desorption Ionisation ion source as claimed in claim 1, wherein said sample to be analysed is mounted or otherwise provided on said target.

3. A Matrix Assisted Laser Desorption Ionisation ion source as claimed in claim 1, wherein said target is at least partially formed from said sample to be analysed.

4. A Matrix Assisted Laser Desorption Ionisation ion source as claimed in claim 1, wherein said liquid is arranged to be supplied on to the surface of said target and/or said surface of said sample to be analysed.

5. A Matrix Assisted Laser Desorption Ionisation ion source as claimed in claim 1, wherein said flow of said liquid comprises a substantially continuous flow of said liquid.

6. A Matrix Assisted Laser Desorption Ionisation ion source as claimed in claim 1, wherein said liquid comprises one or more extraction solvents and/or one or more Matrix Assisted Laser Desorption Ionisation matrix substances.

7. A Matrix Assisted Laser Desorption Ionisation ion source as claimed in claim 6, wherein said one or more extraction solvents and/or said one or more Matrix Assisted Laser Desorption Ionisation matrix substances are arranged to draw out or extract one or more analytes from said target and/or said sample to be analysed.

8. A Matrix Assisted Laser Desorption Ionisation ion source as claimed in claim 1, wherein said laser beam is arranged and adapted to ionise said analyte molecules in said liquid junction.

9. A Matrix Assisted Laser Desorption Ionisation ion source as claimed in claim 1, further comprising a focusing device for focusing said laser beam to a focal point.

10. A Matrix Assisted Laser Desorption Ionisation ion source as claimed in claim 9, wherein said focal point is arranged so as to be located either upstream of said target, within said target, upon an upper surface of said target or sample to be analysed, at a location immediately adjacent an upper surface of said target or sample to be analysed or at a location downstream of an upper surface of said target or sample to be analysed.

11. A Matrix Assisted Laser Desorption Ionisation ion source as claimed in claim 1, wherein said laser beam is arranged to impinge upon a rear surface of said target and to pass through said target so as to ionise analyte present in a liquid junction located on an upper surface of said target or said sample to be analysed.

12. A Matrix Assisted Laser Desorption Ionisation in source as claimed in claim 1, wherein said laser beam is arranged to impinge upon an upper surface of said target or said sample to be analysed, optionally without substantially being transmitted through said target, so as to ionise analyte present in a liquid junction located on an upper surface of said target or said sample to be analysed.

13. A mass spectrometer comprising a Matrix Assisted Laser Desorption Ionisation ion source as claimed in claim 1.

14. A mass spectrometer as claimed in claim 13, further comprising an Electrospray Ionisation ion source.

15. A mass spectrometer as claimed in claim 14, wherein said Electrospray Ionisation ion source is arranged and adapted to ionise or further ionise said analyte plume released from said liquid junction.

16. A method of ionising a sample comprising:

providing a Matrix Assisted Laser Desorption Ionisation ion source;

supplying a flow of liquid on to the surface of a target or a sample to be analysed so that said liquid forms a liquid junction on the surface of said target or said sample to be analysed and so that analyte molecules to be ionised are extracted into said liquid junction; and using a laser beam to cause analyte ions or an analyte plume to be released or desorbed from said liquid junction.

17. A method of mass spectrometry comprising a method as claimed in claim 16.

18. An interface for an ion source comprising:

a first device arranged and adapted to supply a flow of liquid on to the surface of a target or sample to be analysed wherein said liquid is arranged to extract analyte molecules from said target or sample to be analysed so that a liquid junction comprising analyte molecules is formed on the surface of said target or sample to be analysed; and a second device arranged and adapted to desorb or release an analyte plume from said liquid junction, wherein said second device comprises a laser desorption device, an acoustic desorption device or a thermal desorption device.

19. An ion source comprising an interface as claimed in claim 18.

20. An ion source as claimed in claim 19, wherein said ion source comprises a corona discharge ion source, a glow discharge ion source, a surface collision ion source or an Electrospray Ionisation ion source and wherein said ion source is arranged and adapted to ionise or further ionise said analyte plume.

* * * * *